United States Patent [19]

Chun et al.

[11] Patent Number: 4,998,958

[45] Date of Patent: Mar. 12, 1991

[54] MULTITOOL PUNCH HOLDER

[75] Inventors: Victor L. Chun, Holland; James R. Hunter, Chadds Ford, both of Pa.

[73] Assignee: Murata Wiedemann, Inc., King of Prussia, Pa.

[21] Appl. No.: 555,375

[22] Filed: Jul. 20, 1990

Related U.S. Application Data

[63] Continuation of Ser. No. 355,252, May 22, 1989, abandoned.

[51] Int. Cl.[5] ..... B26F 1/08

[52] U.S. Cl. ..... 83/133; 83/140; 83/552; 83/618

[58] Field of Search ..... 83/140, 552, 549, 618, 83/556, 559, 563, 146, 143, 133

[56] References Cited

U.S. PATENT DOCUMENTS

| | | | |
|---|---|---|---|
| 3,139,779 | 7/1964 | Bredow | 83/552 X |
| 3,160,046 | 12/1964 | Bredow | 83/552 X |
| 3,527,130 | 9/1970 | Knehans | 83/552 X |
| 3,540,339 | 11/1970 | Killaly | 83/552 X |
| 4,532,845 | 8/1965 | Jinnouchi | 83/552 |
| 4,555,966 | 12/1985 | Klingel | 83/549 X |
| 4,569,267 | 2/1986 | Klingel | 83/552 |
| 4,779,329 | 10/1988 | Nordquist et al. | 83/552 |

*Primary Examiner*—Hien H. Phan
*Assistant Examiner*—Kenneth E. Peterson
*Attorney, Agent, or Firm*—John R. Benefiel

[57] ABSTRACT

A multitool punch holder is disclosed in which a tool carrier (22) holds a circumferential array of punches (76) in a corresponding series of bores. Each punch (76) is attached to a stem rod (50) having an upper end protruding above the tool carrier (22). The tool carrier (22) is rotated by an index drive (102, 104, 106, 108) so as to bring a selected one of the stem rods (50) beneath a ram drive features (100) protruding radially outward to lie above the stem rod ends (52). The tool carrier (22) is coupled to the ram (14) by a head member (20) which is telescopically received therein allowing the ram (14) to continue its descent after contact of the tool carrier (22) with the workpiece, the ram (14) having a feature (100) engaging a selected stem rod end (52) lying beneath the ram drive feature (100) to cause advance of the attached punch (76) against the resistance of an encircling stripper spring (62).

1 Claim, 1 Drawing Sheet

MULTITOOL PUNCH HOLDER

This application is a continuation of application Ser. No. 07/355,252, filed May 22, 1989, now abandoned.

This invention concerns tool holders and more particularly holders for carrying punches in punch presses, particularly punch presses having rotary turrets carrying punches to enable automated punch changing. There has heretofore been developed punch presses having upper and lower turret plates respectively carrying a circumferential array of punches and mating dies able to be selectively indexed to a punch ram. This enables automated changing of punches and dies in the operation of the punch press.

The punches have also been mounted and driven to enable indexing about their own axis in order to change the orientation of the punch for a given punching operation. An example of such indexed tool holder is described in U.S. Pat No. 4,412,469 issued on Nov. 1, 1983 for "Turret Punch Presses Having Tool Holders Rotatably Mounted in the Turrets".

It would greatly increase the number of punches available if a number of punches were included at each station in the turret, in a rotary holder itself able to rotate about its own axis, and such multitool punch holders have heretofore been proposed. Examples of these are described in U.S. Pat. No. 4,569,267 issued on Feb. 11, 1986 for a "Multitool Punch Mechanism" and U.S. Pat. No. 4,779,329 issued on Oct. 25, 1988 for a "Tool Changer for Rotatable Tool Assemblies in Punching Machines".

However, it is important that such punch holders be able to generate sufficient stripping forces to insure reliable punching, i.e., to exert punch withdrawl forces after punch penetration of the workpiece has occured.

It is also important that such rotary indexing tool holders be simple and reliable in operation.

SUMMARY OF THE INVENTION

The present invention comprises a multitool punch holder of the rotary indexing type in which a tool carrier cylinder is provided mounted in an axially fixed sleeve rotatable about its axis by an indexing drive.

The tool carrier is formed with a plurality of axial bores arranged about the carrier rotary axis, each bore adapted to slidably receive a punch stem rod, each having a punch at the lower end thereof. Each punch stem is formed with a plunger portion protruding above the tool carrier and indexable beneath a protuberance formed on the punch ram so as to be selectively driven as the ram is reciprocated.

A stripper spring surrounding each punch stem resists advancing by the ram stroke, and acts as a stripping spring to withdraw the associated punch after workpiece penetration.

The ram is secured to the tool carrier by a head member telescoped into the tool carrier, axially movable therein against the resistance of a compression spring serving to maintain each punch stem rod below the ram drive feature during indexing of the tool holder.

A stripper plate is mounted to the lower face of the tool carrier, and engages the workpiece as the ram strokes to initiate driving of a selected stem and punch beneath the ram drive feature.

This multitool punch holder assembly has the advantage of providing a multitool selection but of a simple and reliable configuration, and at the same time generating adequate punch stripping forces.

DETAILED DESCRIPTION

Figure 2:
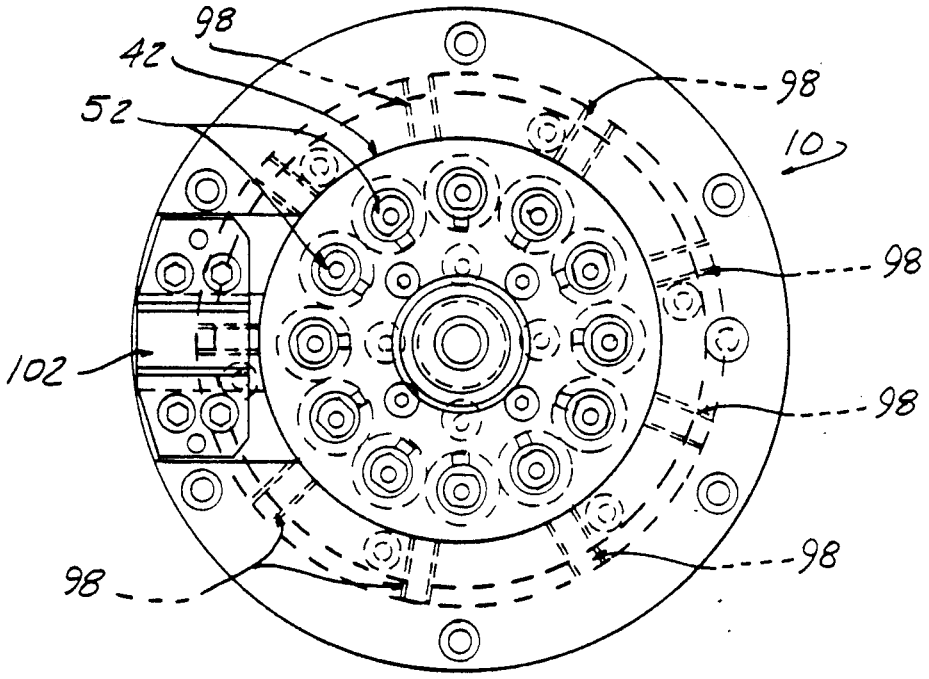
FIG. 2 is an end view of the punch holder shown in FIG. 1.
Figure 1:
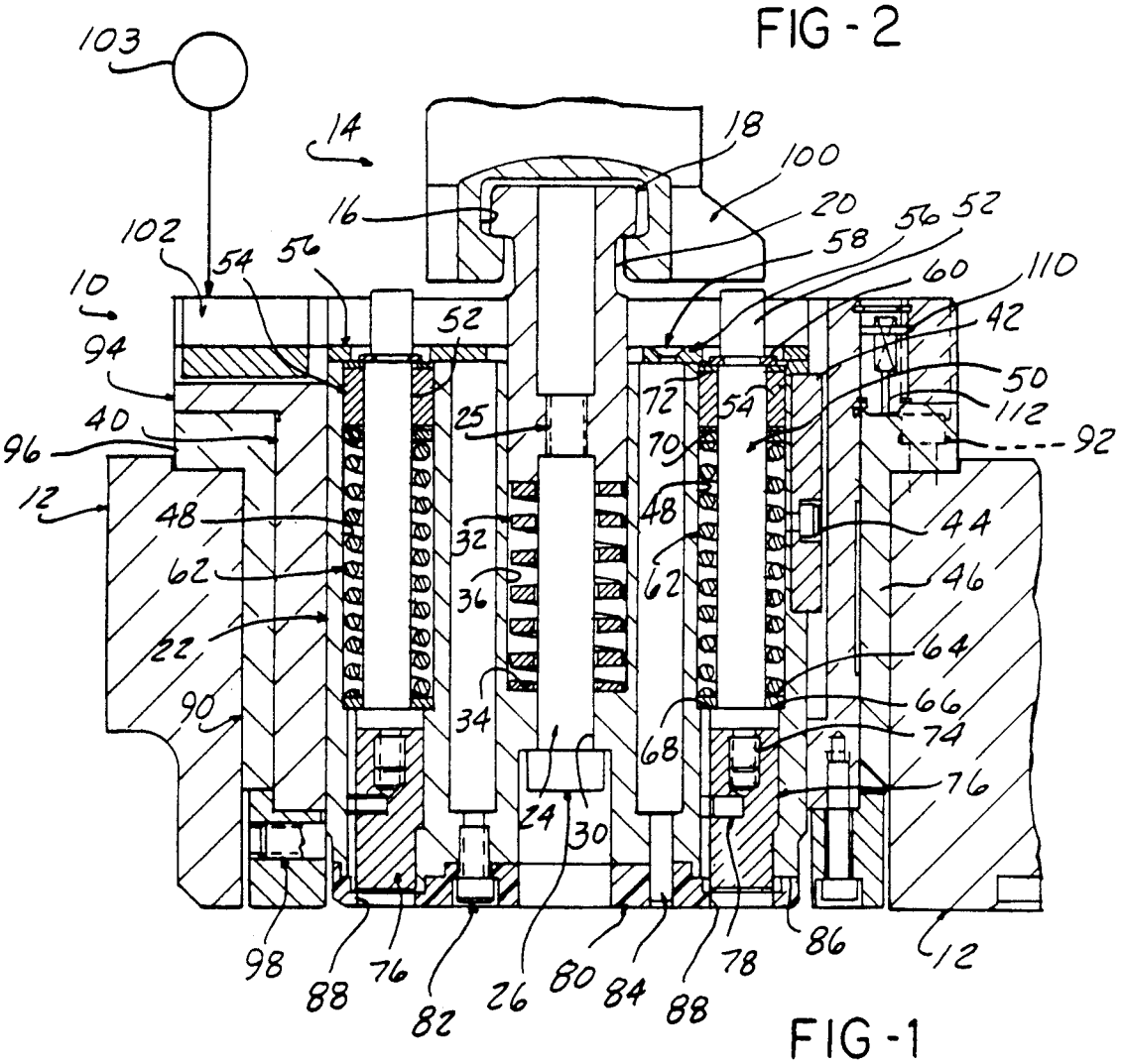
FIG. 1 is a longitudinal sectional view through a multitool punch holder according to the present invention, with a fragmentary portion of associated punch press structure.

FIGS. 1 and 2 illustrate the multitool punch holder 10 according to the present invention, shown installed in the upper turret plate 12 of a rotary turret punch press. The press ram 14 is formed with a tee slot 16 which received a tee shaped head 18 of a tee member 20 included in the holder assembly 10. The tee member 20 is telescopically received into a cylindrical tool carrier 22 by a mounting rod 24 threaded at 25 into the lower end of tee member 20, having a head 26 seated against an endwall 28 in a bore 30 formed in the tool carrier 22 slidably receiving the mounting rod 24.

A return compression spring 32 encircles the mounting rod 24 and is seated against endwall 34 of the bore 36 slidably receiving the tee member 20. This urges the tool carrier 22 downwardly to be lowered away from the ram 14 prior to stroking of the ram, as shown in FIG. 1.

The tool carrier 22 is mounted in an index sleeve 40 so as to be axially movable therein, but locked against relative rotation by a key 42 secured to the tool carrier 22 with a screw 44, and mating with a keyway slot 46 formed in the index sleeve 40.

The tool carrier 22 is formed with a series of twelve axial bores 48 spaced radially outward from the centerline of the tool carrier, in a circumferential array. Each bore 48 is adapted to receive a punch stem rod 50, extending parallel to each other, having an upper plunger end 52 guided through a bronze bushing 54 and protruding above the upper end face of the tool carrier 22. A retainer plate 56 is secured to the end face 56 with screws 58, and keeps the punch stem rods 50 in position in the bores 48.

A stripper spring 62 encircles each punch stem rod 50, and is seated against a thrust washer 64 abutting a shoulder 66 in the lower section of bore 48 and shoulder 68 of the stem rod 50. The stripper springs 62 also act against a thrust washer 70 beneath the bronze bushing 54. Downward movement of the stem rods 50 is resisted by compression of the stripper springs 62 by snap rings 60 acting on the thrust washer 72 and bushing 54 and thrust washer 70.

The stem rods 50 each include a threaded section 74 received in a punch 76. Alternatively, the stem rods 50 and punches 76 may be made one piece to reduce costs. An antirotation dowel 78 maintains the orientation of the punch 76.

A urethane stripper end cap 80 is secured with capscrews 82 and dowels 84 to the lower end face 86 of the tool carrier with punch openings 88 aligned with each punch 76, preferably formed by the punches themselves in the initial cycle of operation.

The index sleeve 40 is rotatably received in a bushing sleeve 90 fixed in the upper turret plate 12 with capscrews 92. The index sleeve 40 is restrained axially by means of a flange 94 resting on flange 96 of the bushing sleeve 90, but free to rotate. The tool carrier 22 rotates with the index sleeve 40, but is axially movable therein. A series of spring plunger assemblies 98 yieldably retains the tool carrier 22 axially within the index sleeve 40.

The index sleeve 40 is adapted to be rotationally driven to index each stem rod end 52 beneath an asymmetric ram engagement feature 100 extending radially out from the main shape of the ram 14 to lie above a single stem rod end 52. This thereby enables selective punching by ram descending motion with a single selected punch 78 indexed to that position.

The rotation of the index sleeve 40 may be carried out by an index drive arrangement 103 mating with a vee block drive feature 102 attached to the upper side of flange 94, such index drive 103 could include a drive wedge axially movable on a plate to seat in the vee block drive feature 102, the drive wedge, driven by a worm to enable rotation to index the tool carrier 22.

A "home" detent comprised of a spring plunger assembly 110 seats in a pocket 112 in the flange 96 of bushing 90. The punch holder assembly 10 is located initially by seating of the spring plunger 110, which prevents unintended movement out of the home position even if a considerable delay occurs prior to the initial indexing cycle.

In operation, the turret plate 12 is rotated to engage the ram 14 with the head member 20.

The indexing drive is activated to bring a selected one of the stem rods 50 beneath the ram engagement feature 100.

The ram 16 is then stroked, causing tool carrier 22 to descend with the head member 20 until the stripper plate 80 engages the surface of a workpiece. The head member 20 continues to descend with the ram, telescoping by sliding into the bore 36 against the resistance of compression spring 32.

The tool carrier 22 being arrested against any further axial movement, the ram feature 100 descends to engage the protruding end 52 of the stem rod 50 located therebelow. This causes the attached punch 76 to be driven through workpiece against the resistance of the encircling stripper spring 62.

As the ram 14 thereafter ascends, the stripper spring 62 forces the stem rod 50 upward to withdraw the attached punch 76 from the workpiece.

Continued ascent of the ram 14 raises the tool carrier 22 to the return position, and draws the head memeber 20 out of the bore 36, with the spring 32 holding it in this position after the ram moves out of engagement with the tee shaped portion 18.

We claim:

1. A multitool punch holder (10) for a punch press having a rotary turret (12) formed with a series of tool receiving stations arrayed about the circumference of said rotary turret (12), said punch press also having a vertically reciprocal ram aligned with tooling at one of said turret stations, said punch holder including a tool carrier cylinder (22) having a longitudinal axis; means (40, 90) adapted to rotatably support said tool carrier cylinder (22) in said turret (12); indexing means (102, 103) for rotating said tool carrier cylinder (22) about said axis through a series of rotary indexed positions; said tool carrier cylinder (22) formed with an array of bores (48) distributed equidistantly about the axis of said tool carrier cylinder (22), each corresponding to one of said indexed positions, a punch (76) slidably mounted in each respective bore (48), each punch (76) having a stem rod (50) attached thereto having, a plunger end (52) protruding above said tool carrier cylinder (22); a drive member (20) having one end extending into said tool carrier cylinder (22) and an upper end (18) protruding thereabove, said upper end (18) configured with a tee shape to be adapted to be coupled with said ram (14) by passing into a tee slot (16) in said ram (14) as said rotary turret (12) rotates said tool carrier cylinder (22) to said one station; a spring (32) interposed between said drive member (20) and said tool carrier cylinder (22) enabling said ram (14) to drive said tool carrier cylinder (22) downward until said tool carrier cylinder (22) movement is arrested by engagement with workpiece and thereafter said spring (32) compressed to allow continued descending movement of said ram (14) with said tool carrier (22) stationary against said workpiece; said ram (14) having a drive feature (100) aligned with a punch stem rod end (52) in each indexed position of said tool carrier cylinder (22), said stem rod end (52) located so as to be first engaged by said ram drive feature (100) as said ram (14) descends past the point at which said tool carrier cylinder (22) movement is arrested, to thereafter cause said ram (14) to drive said punch (76) to punch said workpiece; a stripper spring (62) associated with each punch (76) resisting said driving motion thereof in said bore (48) to urge retraction of said punch (76) after raising of said ram (14);

said means (40, 90) adapted to rotatably support said tool carrier cylinder (22) in said turret (12) including an axially fixed rotary sleeve (40) driven by said indexing means (102, 103); means (42) rotatably coupling said sleeve (40) to said tool carrier cylinder (22) while accomodating ralative axial movement therebetween; a series of radially extending spring urged plungers (98) mounted in said sleeve (40) and engaging the periphery of said tool carrier cylinder (22) to yieldably retain said tool carrier cylinder (22) in an elevated position in said sleeve (40) upon retraction of said ram (14) to its raised position.

* * * * *

UNITED STATES PATENT AND TRADEMARK OFFICE

CERTIFICATE OF CORRECTION

PATENT NO. : 4,998,958

DATED : March 12, 1991

INVENTOR(S) : Victor L. Chun and James R. Hunter

It is certified that error appears in the above-identified patent and that said Letters Patent is hereby corrected as shown below:

In the Abstract, line 8, "features" should be --feature--.

Column 1, line 36, "occured" should be --occurred--.

Column 3, line 47, "memeber" should be --member--.

Column 4, line 46, "accomodating ralative" should be --accommodating relative--.

Signed and Sealed this

Twenty-fourth Day of August, 1993

Bruce Lehman

*Attest:*

BRUCE LEHMAN

*Attesting Officer*

*Commissioner of Patents and Trademarks*